US011197794B2

(12) United States Patent
Chang et al.

(10) Patent No.: US 11,197,794 B2
(45) Date of Patent: Dec. 14, 2021

(54) TURNING AIR MATTRESS, TURNING AIR CELL, AND CONTROL METHOD FOR AIR MATTRESS

(71) Applicant: APEX MEDICAL CORP., New Taipei (TW)

(72) Inventors: Ming-Lung Chang, New Taipei (TW); Ming-Heng Hsieh, New Taipei (TW); Wen-Ching Cheng, New Taipei (TW); Pi-Kai Lee, New Taipei (TW); Yu-Chen Liu, New Taipei (TW); Fang-Ju Chou, New Taipei (TW)

(73) Assignee: APEX MEDICAL CORP., New Taipei (TW)

( * ) Notice: Subject to any disclaimer, the term of this patent is extended or adjusted under 35 U.S.C. 154(b) by 147 days.

(21) Appl. No.: 16/537,898

(22) Filed: Aug. 12, 2019

(65) Prior Publication Data

US 2020/0078241 A1 Mar. 12, 2020

(30) Foreign Application Priority Data

Sep. 11, 2018 (TW) ..... 107131837

(51) Int. Cl.

| | |
|---|---|
| ***A61G 7/057*** | (2006.01) |
| ***A47C 27/10*** | (2006.01) |
| ***A47C 27/08*** | (2006.01) |
| ***A61G 13/12*** | (2006.01) |
| ***A61G 7/00*** | (2006.01) |
| *A47C 23/047* | (2006.01) |

(Continued)

(52) U.S. Cl.

CPC ..... *A61G 7/05776* (2013.01); *A47C 27/082* (2013.01); *A47C 27/10* (2013.01); *A61G 7/001* (2013.01); *A61G 7/05769* (2013.01); *A61G 13/1265* (2013.01); *A47C 23/047* (2013.01); *A47C 27/083* (2013.01); *A47C 27/084* (2013.01); *A47C 27/128* (2013.01); *A47C 27/18* (2013.01); *A61G 2200/32* (2013.01)

(58) Field of Classification Search

CPC ..... A61G 7/05776; A61G 13/1265; A61G 7/05769; A61G 7/001; A61G 2200/32; A47C 27/10; A47C 27/082; A47C 27/083; A47C 27/084; A47C 27/18; A47C 23/047; A47C 27/128

See application file for complete search history.

(56) References Cited

U.S. PATENT DOCUMENTS 4,346,489 A * 8/1982 McMullan ..... A47C 27/085 5/679

4,686,722 A * 8/1987 Swart ..... A61G 7/05769 5/713

(Continued)

*Primary Examiner* — Robert G Santos
*Assistant Examiner* — Rahib T Zaman
(74) *Attorney, Agent, or Firm* — WPAT, PC

(57) ABSTRACT

The present invention discloses a turning air mattress, a turning air cell, and a control method for a turning air mattress. With structural arrangements of an upper portion and a lower portion of the turning air cell as well as inflation and deflation control, the turning air cell having an upper portion that is wider and a lower portion that is narrower can further assist a patient in body turning, enabling the patient to easily achieve a sufficient body turning angle, further reducing the risk of likeliness to pressure sores caused by the structure of the air mattress pressing against the body of the patient.

10 Claims, 13 Drawing Sheets

(51) Int. Cl.
*A47C 27/12* (2006.01)
*A47C 27/18* (2006.01)

(56) References Cited

U.S. PATENT DOCUMENTS 5,396,671 A * 3/1995 Stacy ..... A61G 7/05776 297/DIG. 3
5,774,917 A * 7/1998 Liu ..... A61G 7/001 5/609
5,794,289 A * 8/1998 Wortman ..... A61G 7/001 5/423
5,966,762 A * 10/1999 Wu ..... A61G 7/05769 5/615
6,085,372 A * 7/2000 James ..... A61G 7/001 5/713
6,601,253 B1 * 8/2003 Tarquinio ..... A47C 21/08 5/727
7,296,314 B2 * 11/2007 Wyatt ..... A61G 7/05715 5/706
7,441,290 B1 * 10/2008 Flick ..... A61G 7/05715 5/615
7,464,422 B2 * 12/2008 Townsend ..... A61G 7/001 5/615
7,735,171 B2 * 6/2010 Kan ..... A61G 7/0525 5/732
8,832,882 B2 * 9/2014 Roberts ..... A47C 27/14 5/690
2015/0136146 A1 * 5/2015 Hood ..... A61G 7/0525 128/845
2015/0335507 A1 * 11/2015 Emmons ..... A61B 5/6892 5/615

* cited by examiner

A-A

TURNING AIR MATTRESS, TURNING AIR CELL, AND CONTROL METHOD FOR AIR MATTRESS

BACKGROUND OF THE INVENTION

Field of the Invention

The present invention relates to a turning air mattress, a turning air cell and a control method for an air mattress capable of assisting a patient in body turning.

Description of the Prior Art

For a patient in bed rest for an extended period of time and incapable of voluntary movement, due to long-term reclination in bed, if the body lacks appropriate turning or activities, the skin constantly in a pressed state is prone to an issue of pressure sores, causing discomfort of the patient or even health hazards of the patient in more severe cases.

Thus, medical grade air mattresses are extensively used in the care industry. By controlling the pressure of an air cell of an air mattress, it is ensured that the pressure (or referred to as an interface pressure) between the skin of the patient and the mattress is maintained at an ideal state, such that the issue of the skin or subcutaneous tissues being pressed over an extended period of time can be prevented for a patient in a reclined position, and blood circulation can thus be kept unobstructed. Accordingly, pressure sores can be avoided. Further, some air mattresses provide a function of body turning. More specifically, by adjusting inflation and deflation of a plurality of air cells in the air mattress, effects of body tilting and thus body turning can be achieved for a patient on the air mattress along with differentiated control of the air cells.

Air cells of a conventional air mattress can assist the body of a patient to tilt as described above. However, with the increase in the tilted angle, the body of the patient is likely to slide on an inclined surface formed by the corresponding air cells, in a way that the body may become deviated from the centerline of the air mattress, leading to an insufficient final body turning angle (e.g. less than 28°) and situations unfavorable to the patient. For example, for a patient with hydronephrosis, a sufficient body turning angle is required. Further, clothes easily become creased and friction is also increased during the sliding process, and the body of the patient may even slide and press upon guardrails on the sides of the bed. All of the above situations may increase the risk of pressure sores.

SUMMARY OF THE INVENTION

It is an object of the present invention to provide an air mattress capable of assisting a patient in body turning and helping a patient achieve an appropriate body turning angle by reducing sliding of the body.

To achieve the above and other objects, a turning air mattress provided according to an embodiment of the present invention includes at least one turning air cell. The turning air cell includes an upper portion and a lower portion. The lower portion is located on a side opposite to the upper portion, and a width of the lower portion is smaller than a width of the upper portion. The turning air cell has a left air chamber and a right air chamber.

In one embodiment, the turning air cell can be arranged along a length direction of the turning air mattress.

In one embodiment, a ratio of the width of the lower portion to the width of the upper portion can between 33% and 75%.

In one embodiment, each of the left air chamber and the right air chamber can have a first ventilation hole, which is configured at a position closer to the upper portion.

In one embodiment, the turning air mattress can further include a movement preventing unit provided on any one of left and right sides of the turning air cell. The movement preventing unit includes a leaning portion that can be leaned against by the turning air cell.

In one embodiment, the movement preventing unit can have a second ventilation hole, and a diameter of the second ventilation hole is smaller than a diameter of the first ventilation hole. Further, the leaning portion can be an inclined surface or a multiple arc surfaces. Further, the movement preventing unit can be an air cell or foam sponge.

In one embodiment, the movement preventing unit can have a first air chamber and a second air chamber. The second air chamber is enveloped in the first air chamber. The first air chamber is in communication with the turning air cell, and is not in communication with the second air chamber.

In one embodiment, the turning air mattress can further include a side guard pipe, and the side guard pipe is provided on any one of left and right sides of the turning air cell. The side guard pipe has at least one high portion and at least one low portion. The side guard pipe can be further provided with a pressurization unit.

In one embodiment, the side guard pipe can include a first air cell, a second air cell and a third air cell. The third air cell is enveloped in the second air cell. The first air cell is stacked on the second air cell, and is in communication with the second air cell. The second air cell is not in communication with the third air cell.

In one embodiment, the side guard pipe can be a micropore having a diameter of 1.04±0.0.7 mm.

In one embodiment, the turning air mattress can further include a movement preventing unit and a side guard pipe. The side guard pipe and the movement preventing unit are a formed integral, and the side guard pipe is provided on any one of left and right sides of the turning air cell.

To achieve the above and other objects, a control method for an air mattress is provided according to an embodiment of the present invention. The turning air mattress includes a turning air cell and a movement preventing unit. The movement preventing unit is provided on any one of left and right sides of the turning air cell. The method includes: (a) deflating any air chamber included in the turning air cell; and (b) deflating at least one air chamber included in the movement preventing unit on the same side as the deflated air chamber of the turning air cell. Further, a deflation rate of the any air chamber of the turning air cell can be larger than a deflation rate of the at least one air chamber of the movement preventing unit on the same side.

In one embodiment, the turning air mattress further includes a side guard pipe, and the side guard pipe is provided on any one of left and right sides of the turning air cell. The method can further include: (c) deflating at least one air cell included in the side guard pipe on the same side as the deflated air chamber of the turning air cell.

In one embodiment, the turning air mattress further includes a lower limb air cell. The method can further include: (d) deflating at least one air chamber included in the lower limb air cell on the same side as the deflated air chamber of the turning air cell.

To achieve the above and other objects, a turning air cell further provided according to an embodiment of the present invention includes an upper portion and a lower portion. The lower portion is parallel to the upper portion. A first side portion and a second side portion connect between the upper portion and the lower portion. Between the upper portion and the lower portion is a first height, between the upper portion and the first side portion or the second side portion is a second height, and the second height is smaller than the first height.

In one embodiment, a left air chamber and a right air chamber can be further included, the first side portion is located at the left chamber, and the second side portion is located at the right air chamber.

In one embodiment, a left air chamber and a right air chamber are further included. The left air chamber has a first round angle, the right air chamber has a second round angle, and the first round angle is adjacent to the second round angle.

A turning air mattress, a turning air cell and a control method are disclosed by embodiments of the present invention. With configurations and designs in the structures or control method, a patient is assisted to reach a sufficient body turning angle, and the risk of pressure sores caused by the structure of an air mattress pressing against the body of a patient is effectively reduced.

DETAILED DESCRIPTION OF THE EMBODIMENTS

Objectives, features, and advantages of the present disclosure are hereunder illustrated with specific embodiments, depicted with drawings, and described below.

In the disclosure, descriptive terms such as "include, comprise, have" or other similar terms are not for merely limiting the essential elements listed in the disclosure, but can include other elements that are not explicitly listed and are however usually inherent in the units, components, air mattress, airbags, air cells, structures, devices, systems, portions or regions.

In the disclosure, the terms similar to ordinals such as "first" or "second" described are for distinguishing or referring to associated identical or similar components or structures, and do not necessarily imply the orders of these components, structures, portions or regions in a spatial aspect. It should be understood that, in some situations or configurations, the ordinal terms could be interchangeably used without affecting the implementation of the present invention.

In the disclosure, descriptive terms such as "a" or "one" are used to describe the unit, component, air mattress, airbag, air cell, structure, device, system, portion or region, and are for illustration purposes and providing generic meaning to the scope of the present invention. Therefore, unless otherwise explicitly specified, such description should be understood as including one or at least one, and a singular number also includes a plural number.

Figure 1:
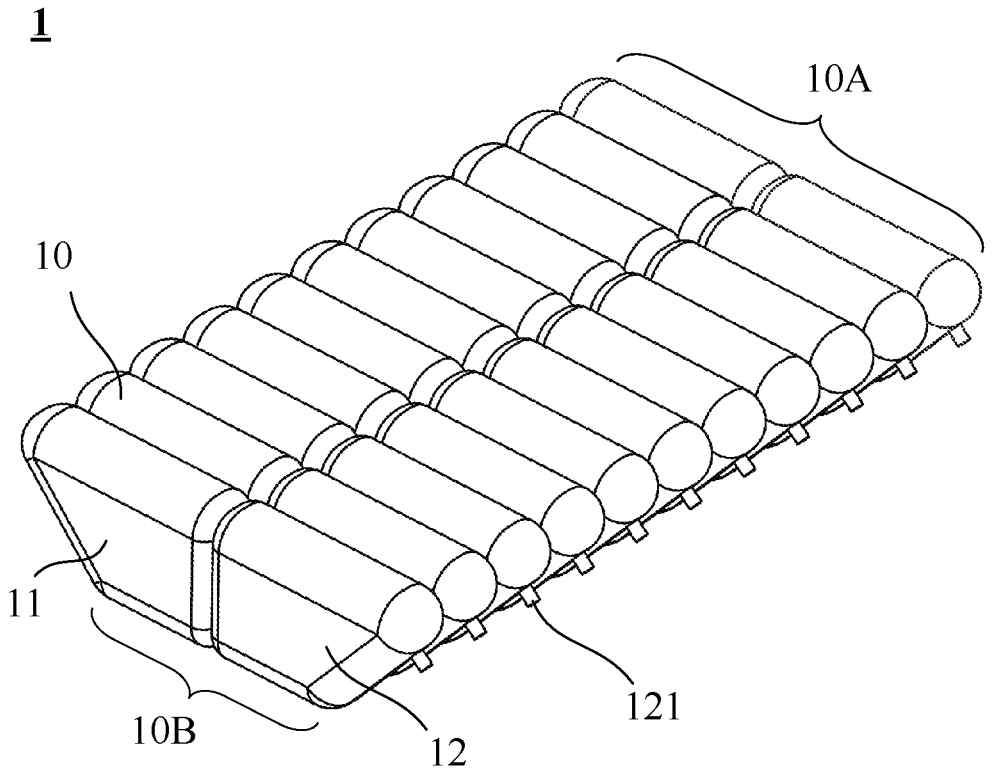
FIG. 1 is a perspective structural schematic diagram of a turning air mattress according to a first embodiment of the present invention.
Figure 2:
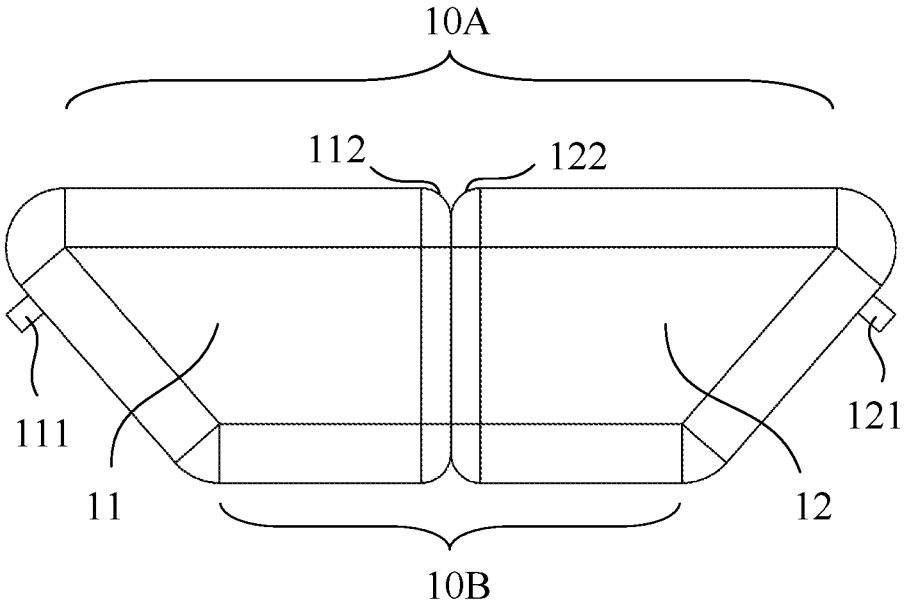
FIG. 2 is a front structural diagram of a turning air cell according to the first embodiment of the present invention.

FIG. 1 and FIG. 2 show a perspective structural schematic diagram of a turning air mattress and a front structural diagram of a turning air cell according to a first embodiment of the present invention. A turning air mattress 1 of the embodiment includes at least one turning air cell 10 that is to be inflated to provide support to a patient reclining thereon. Further, the turning air cell 10 can also be controlled to perform corresponding inflation and deflation to further assist a patient in body turning. FIG. 1 depicts a plurality of turning air cells 10 arranged together, and a part that the turning air mattress 1 provides a body turning function can be combined from these turning air cells 10, or another part capable of helping body turning can be combined from these turning air cells 10.

As shown in FIG. 1 and FIG. 2, the turning air cell 10 includes an upper portion 10A and a lower portion 10B. The lower portion 10B is located on a side opposite to the upper portion 10A, and a width of the lower portion 10B is smaller than a width of the upper portion 10A. The widths of the upper portion 10A and the lower portion 10B can include or exclude parts of round angle shown in FIG. 1 and FIG. 2, preferably, excluding the parts of the round angles to serve as measurements of the widths (as shown in FIG. 1 and FIG. 2). The turning air cell 10 can be manufactured to have a left air chamber 11 and a right air chamber 12, and inflation and deflation are correspondingly performed by controlling the left air chamber 11 or the right air chamber 12. The correspondingly inflated left half or right half of the turning air cell 10 provides a corresponding left half or right half of the body of a patient with support, and the deflated part causes the corresponding side of the body of the patient to gradually descend such that the body of the patient becomes tilted, thus achieving the object of body turning.

As shown in FIG. 1, the turning air mattress 1 of the embodiment can be entirely or partly be formed by the turning air cell 10. When the turning air mattress 1 includes a plurality of turning air cells, the turning air cells 10 are arranged along a length direction of the turning air mattress 1.

In the embodiment, the width of the lower portion 10B can be smaller than the width of the upper portion 10A; that is, the area of the upper portion 10A for supporting the body weight of the patient is greater than that of the lower portion 10B. Thus, at position of two ends of the lower portion 10B corresponding to the upper portion 10B, bent points can be formed on the upper portion 10A. When a corresponding air chamber is deflated, the bent point of the corresponding side can enable the turning air cell 10 to provide a better effect in helping the patient with body turning.

In an illustrative example of the shape of the turning air cell 10, because the width of the lower portion 10B is smaller than the width of the upper portion 10A, a cross section of the turning air cell 10 in the width direction appears as a downwardly tapered trapezoid. However, the present invention is not limited to the above example. The cross section of the turning air cell 10 in the width direction can be in another shape, and any implementation form in which the width of the lower portion is smaller than the width of the upper portion is considered an embodiment of the present invention.

In another embodiment, a ratio of the width of the lower portion 10B to the width of the upper portion 10A can be between 33% and 75%. As an illustrative example of the upper portion 10A and the lower portion 10B, the width of the lower portion 10B can be greater than or equal to a minimum shoulder width under basic tests of the human body; for example, the lower portion 10B is preferably 300 to 510 mm, and the upper portion 10A can adapt to widths of shoulders of most patients and is preferably 700 to 900 mm. Further, FIG. 3 shows a sectional structural schematic diagram of a turning air cell according to the embodiment. The turning air cell 10 includes an upper portion 10A and a lower portion 10B, and the lower portion 10B is substantially parallel to the upper portion 10A. Further, a first side portion 10C and a second side portion 10D connect between the upper portion 10A and the lower portion 10B. Between the upper portion 10A and the lower portion 10B is a first height H1, between the upper portion 10A and the first side portion 10C or the second side portion 10D is a second height H2, and the second height H2 is smaller than the first height H1. Thus, the volume of an outer side of the left chamber 11 or the right chamber 12 can be smaller than the volume of an inner side.

In the embodiment, the left air chamber 11 and the right air chamber 12 have respective first ventilation holes 111 and 121. The first ventilation holes 111 and 121 are for transporting air of the left air chamber 11 and the right air chamber 12, for example, for inflating or deflating. Preferably, the first ventilation holes 111 and 121 can be configured at positions closer to the upper portion 10A. If the first ventilation holes 111 and 121 are configured at positions closer to the upper portion 10A, when the left air chamber 11 or the right air chamber 12 is deflated, one side of the body of the patient less likely presses against a hard component such as a connector or a ventilation pipe of the corresponding side, such that discomfort of an alien object less likely occurs.

Further, the first ventilation holes 111 and 121 can also be configured at positions on the first side portion 10C and the second side portion 10D (as shown in FIG. 3) and closer to the upper portion 10A. Thus, on the basis of the design that the volume of an outer side of the left air chamber 11 or the right air chamber 12 of the turning air cell 10 of the embodiment is smaller than the volume of an inner side, when the body turning function is performed, the speed of deflation of the outer side of the turning air cell 10 closer to the first side portion 10C or the second side portion 10D is faster, hence better helping the patient with body turning.

Figure 3A:
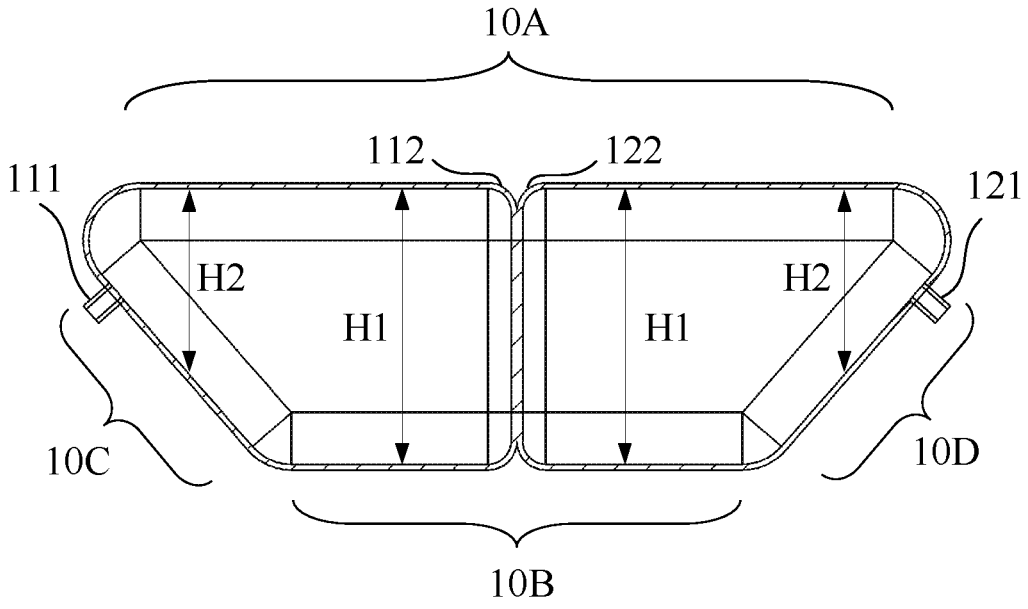
FIG. 3A is a sectional structural schematic diagram of the turning air cell in FIG. 2.

As shown in FIG. 2 and FIG. 3A, in the turning air cell 10 of the embodiment, the left air chamber 11 has a first round angle 112, the right air chamber 12 has a second round angle 122, and the first round angle 112 is adjacent to the second round angle 122. As shown, positions of the first round angle 112 and the second round angle 122 are substantially at a middle part of the upper portion 10A of the turning air cell 10, and can be correspondingly located below the body of the patient. The design of the round angles is for avoiding stress concentrated points formed after the turning air cell 10 is inflated, thus alleviating the issue of air cell breakage caused by an overly large pressure born by the stress concentrated points after the turning air cell 10 is inflated, and keeping the patient free from discomfort when the patient reclines on the air cell.

In one implementation form, at least one pull strap, a separation film or the like can be provided in the left air chamber 11 or the right air chamber 12, such that an opposite sidewall in the left air chamber 11 or the right air chamber 12 can be connected by the at least one pull strap, the separation film or the like, and two sidewalls opposite to each other in the left air chamber 11 or the right air chamber 12 can be held by pulling, further defining the shape of the turning air cell 10 that is fully inflated, and allowing the placement and arrangement among the air cells to become easy. Accommodating chambers of the left air chamber 11 or the right air chamber 12 connected by the pull strap, the separation film or the like can be configured as being in communication with each other.

In another implementation form, the left air chamber 11 and the right air chamber 12 can be adhered together or the at least one pull strap, separation film or the like can be provided by using high-frequency welding, thus separating at least two separate accommodating chambers (not shown) in the left air chamber 11 or the right air chamber 12. The at least two separate accommodating chambers are in a top-bottom configuration and each have ventilation holes for controlling inflation and deflation. Preferably, when a body turning function is performed, the separate accommodating chamber configured at the bottom in the left air chamber 11 or the right air chamber 12 is controlled to be deflated before the separate accommodating chamber configured on the top.

Figure 3B:
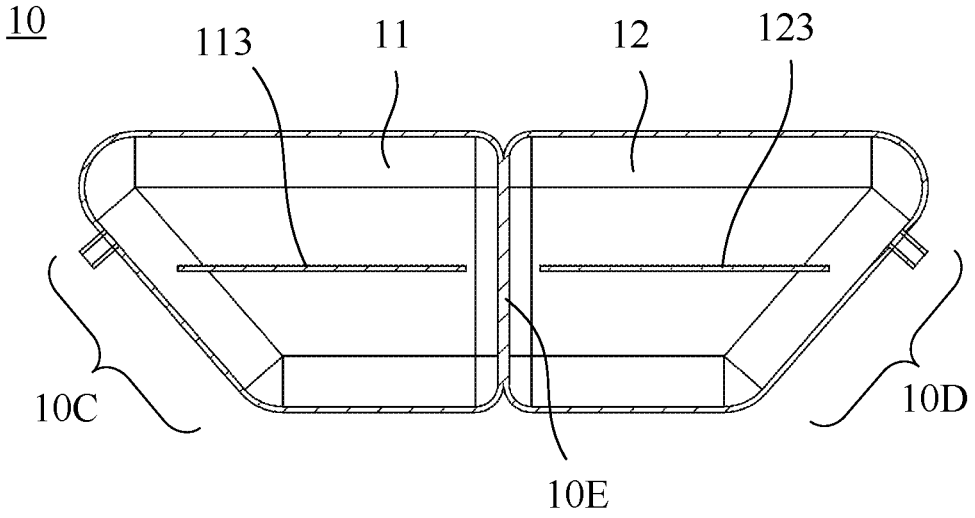
FIG. 3B is a sectional structural schematic diagram of a turning air cell in another implementation form.
Figure 4:
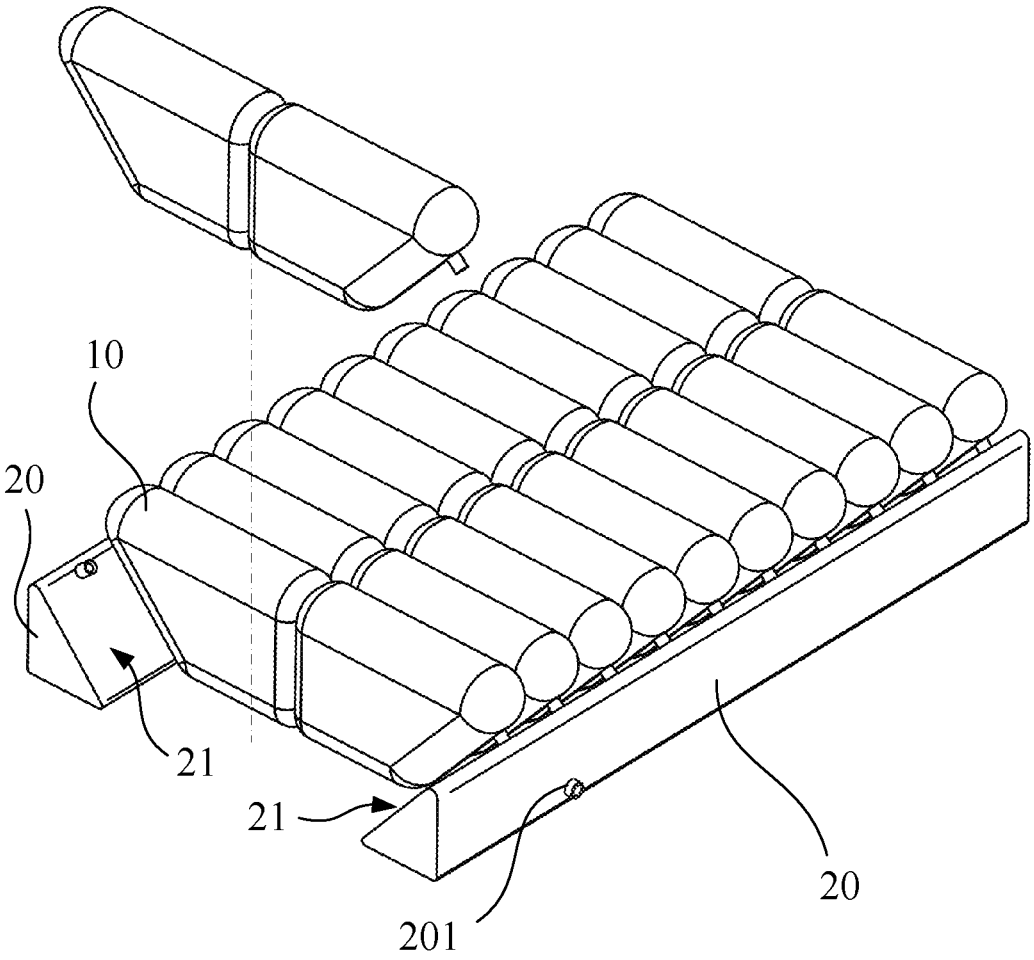
FIG. 4 is a perspective structural schematic diagram of a turning air mattress according to a second embodiment of the present invention.

FIG. 3B shows a sectional structural schematic diagram of a turning air cell in another implementation form. FIG. 4 shows an example of a turning air cell in which respective pull straps 113 and 123 are provided in the left air chamber 11 and the right air chamber 12, wherein the pull straps 113 and 123 allow two opposite sidewalls in the corresponding air chambers to be connected. For example, a distance between the two sidewalls of the left air chamber 11 can be restricted by using the corresponding pull strap 113, further defining the shape of the air chamber after the air chamber is inflated. In the example in FIG. 3B, the separate accommodating chambers are in communication with each other by using the strips 113 and 123. For example, although the pull strap 113 of the left air chamber 11 can separate the left air chamber 11 into an upper accommodating chamber and a lower accommodating chamber, the upper accommodating chamber and the lower accommodating chamber of the left air chamber 11 are still in communication because two left and right ends of the pull strap 113 are not connected to the first side portion 10C or a separation wall 10E of the two left and right air chambers.

Figure 5A:
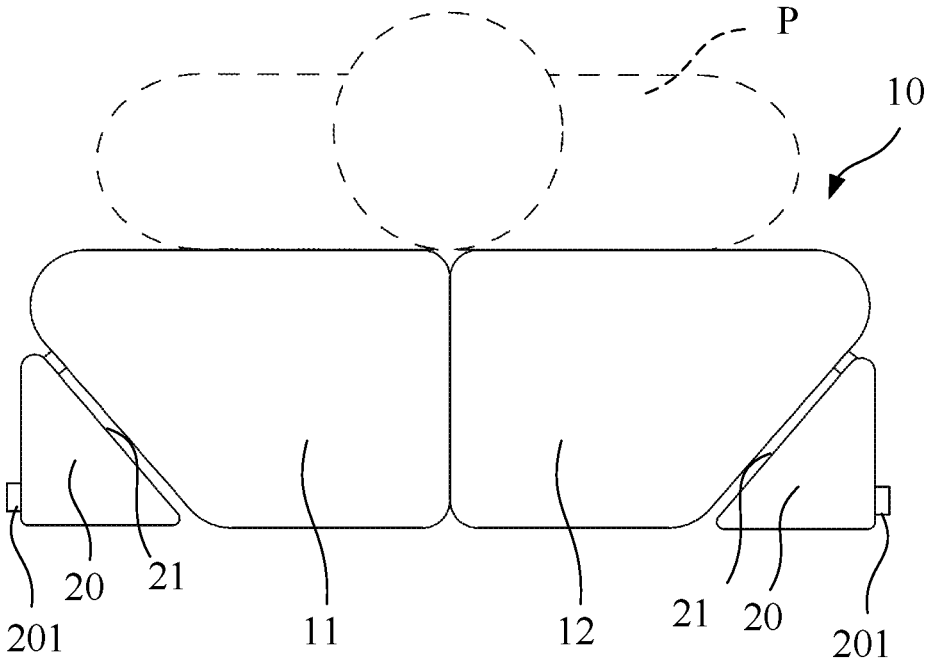
FIG. 5A is a schematic diagram of a turning air mattress according to the second embodiment of the present invention.

FIG. 4 and FIG. 5A show perspective structural schematic diagrams of a turning air mattress and a movement preventing unit according to a second embodiment of the present invention. The turning air mattress 1 of the embodiment further includes a movement preventing unit 20 provided on any one of left and right sides of the turning air cell 10. Preferably, as shown in FIG. 4, one movement preventing unit 20 is provided on both of the left and right sides of the turning air mattress 1; however, the present invention is not limited thereto. The numbers of the movement preventing units 20 on the two left and right sides of the turning air mattress 1 can be equal or different. Alternatively, in adaptation to a body part of the patient, for example, at the chest, abdomen, buttocks, thighs of the patient, corresponding movement preventing units 20 can be respectively placed. Alternatively, one movement preventing unit 20 can be shared by two or more body parts.

Figure 5B:
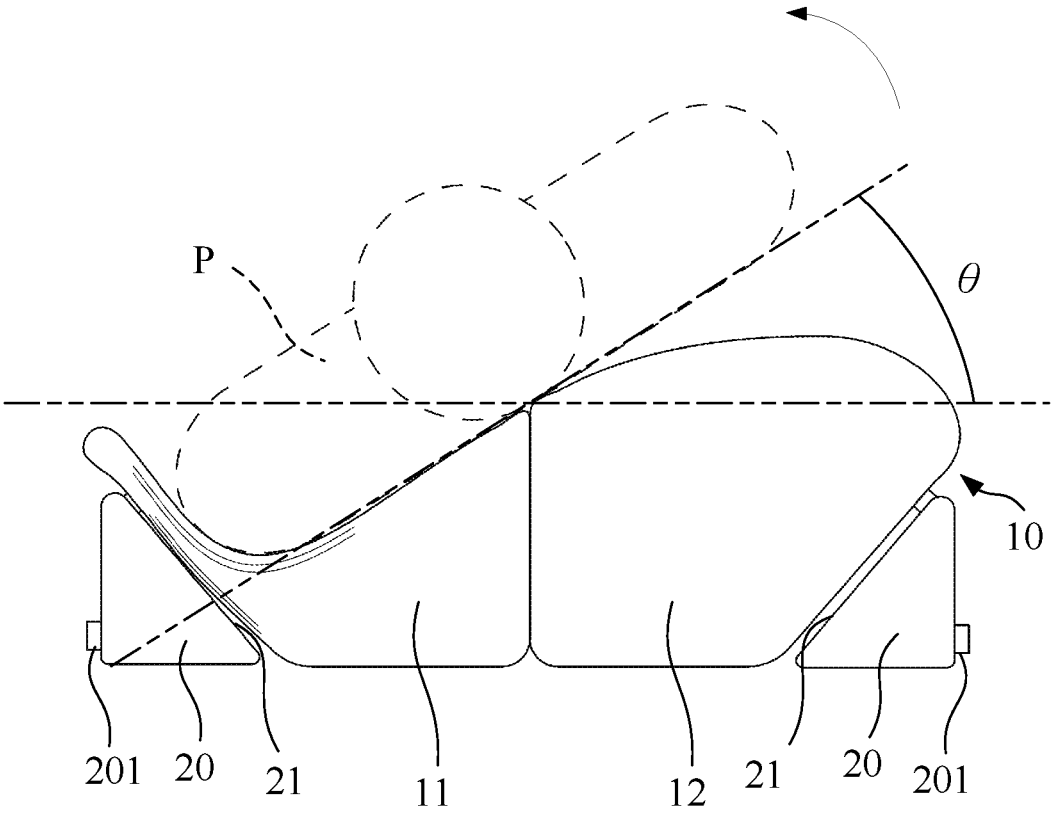
FIG. 5B is a schematic diagram of a body turning state of FIG. 5A.

The movement preventing unit 20 has a leaning portion 21 that can be leaned against by the turning air cell 10. Referring to FIG. 5A and FIG. 5B, when a left body turning function is performed (assuming that the body turning angle is set to θ degrees), the left air chamber 11 of the turning air cell 10 is deflated. At this point, the movement preventing unit 20 is preserved with a certain amount of air or the movement preventing unit 20 is provided with a certain level of supporting force. Thus, the leaning portion 21 can provide the body of a patient P with support, reducing the possibility of the body of the patient P coming into contact with the bottom surface of a hard bed frame as well as alleviating sliding movement caused by tilting of the body, further smoothly achieving an expected body turning angle.

In the turning air mattress 1 of the embodiment, when a body turning function is performed, the movement preventing unit 20 can be configured to deflate or not to deflate synchronously. If the movement preventing unit 20 is configured to also be deflated while the turning air cell 10 is deflated, the range of the body turning angle of the patient can be further increased.

In one implementation form, the rate of deflation of the turning air cell 10 is preferably set to be greater than the rate of deflation of the movement preventing unit 20. For example, the movement preventing unit 20 has second ventilation holes 201 for inflation and deflation, and the diameter of the second ventilation holes 201 can be configured to be smaller than the diameters of the first ventilation holes 111 and 121 of the left air chamber 11 and the right air chamber 12. Air distribution means of the turning air cell 10 and the movement preventing unit 20 are to be described below.

Figure 6:
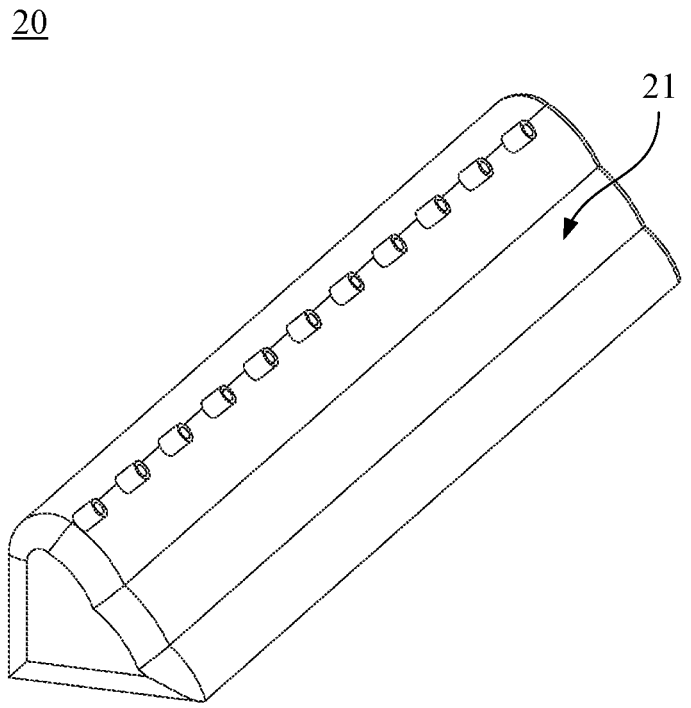
FIG. 6 is a perspective structural schematic diagram of another form of a movement preventing unit according to the second embodiment of the present invention.

In the embodiment, as shown in FIG. 4 and FIG. 5, the movement preventing unit 20 can be a long air cell having a triangular cross section, with a leaning portion 21 thereof being an inclined surface; however, the present invention is not limited to the above example. As shown in FIG. 6, the leaning portion 21 can also be formed by multiple arc surfaces. Further, in addition to being an air cell, the movement preventing unit 20 can also be such as foam or a material providing a supporting force.

Figure 7:
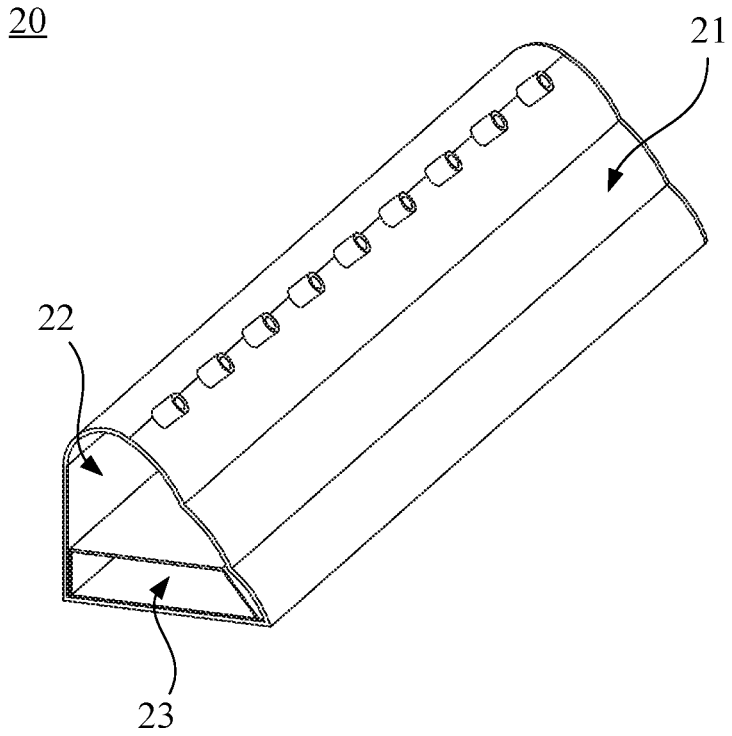
FIG. 7 is an internal structural schematic diagram of a movement preventing unit according to the second embodiment of the present invention.

FIG. 7 shows an internal structural schematic diagram of an implementation form of a movement preventing unit according to the embodiment. The movement preventing unit 20 can include a first air chamber 22 and a second air chamber 23. The second air chamber 23 is enveloped in the first air chamber 22. The first air chamber 22 can be in communication with the turning air cell 10 (not shown), and is not in communication with the second air chamber 23. Thus, when a body turning function is performed, the first air chamber 22 can be controlled for deflation and thus has a function of assisting in body turning. Further, while the first air chamber 22 is controlled for deflation, the second air chamber 23 is still preserved with air so as to provide the patient with a certain level of supporting force.

For example, when the body turning function is performed, the left air chamber 11 or the right air chamber 12 of the turning air cell 10 is deflated, and the first air chamber 22 in the movement preventing unit 20 of the corresponding side is also deflated, further increasing the range of the body turning angle. Meanwhile, because a certain amount of air still exists in the second air chamber 23, the movement preventing unit 20 can provide the body of the patient with a certain level of supporting force, further preventing the body of the patient from coming into contact with the bottom surface of the bed frame. However, the present invention is not limited to the above example. If the first air chamber 22 is stacked on the second air chamber 23, in a way that a bottom surface of the first air chamber 22 is connected to a top surface of the second air chamber 23 rather than having the second air chamber 23 being enveloped in the first air chamber 22, air is still preserved in the second air chamber 23 while the first air chamber 22 is controlled for deflation, such that an effect similar to the above can nonetheless be achieved.

Figure 8:
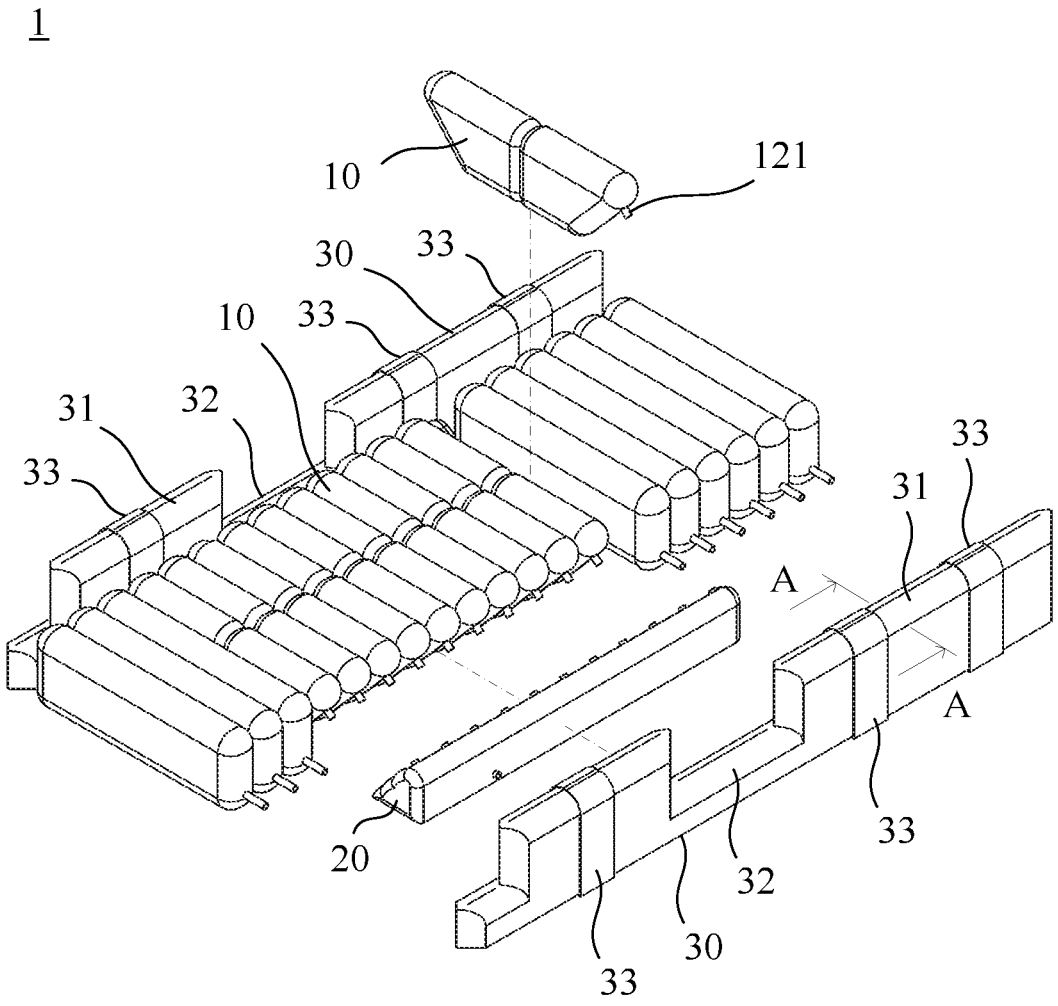
FIG. 8 is a perspective structural schematic diagram of a turning air mattress according to a third embodiment of the present invention.
Figure 9:
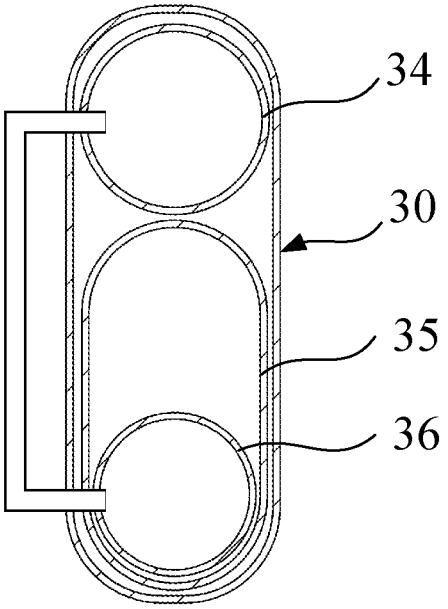
FIG. 9 is a sectional structural schematic diagram of a side guard pipe along A-A according to the third embodiment of the present invention.

FIG. 8 and FIG. 9 show perspective structural schematic diagrams of a turning air mattress and a movement preventing unit according to a third embodiment of the present invention. A turning air mattress 1 of the embodiment further includes a side guard pipe 30. The side guard pipe 30 can be provided on any one of left and right sides of the turning air cell 10 to thereby stop the body of the patient and prevent the patient from falling off on the side of the turning air mattress 1 when the body of the patient is turned. The side guard pipe 30 has a high portion 31 and a low portion 32. The high portion 31 can be as high as or higher than a top surface of the turning air cell 10. The height of the low portion 32 is lower than that of the high portion 31, and the lower portion 32 can be used for placing pipelines and devices installed on the body of the patient, such as drainage tubes draining blood or excretion of the body cavity of the patient, hence facilitating flowing of the fluids in the drainage tubes.

Further, even if the height of the left or the right of the turning air cell 10 is lowered as a result of performing the body turning function, because the drainage tubes can pass by the low portion 32 of the side guard pipe 30, an overly large height difference is not formed when the drainage tubes pass through the part of the side guard pipe 30 and the drained fluids in the drainage tubes can be drained smoothly. In the embodiment, the low portion 32 of the side guard pipe 30 can correspond to positions of the head, chest or abdomen of the patient and can be used for placing, for example, drainage tubes for the head, lungs and abdomen.

As shown in FIG. 8, the turning air mattress 1 of the embodiment preferably includes two side guard pipes 30, with one of which provided on each of two left and right sides of the turning air mattress 1 and closely located to an outer side of the turning air cell 10 and/or the movement preventing pipe 20 on the left or the right.

As shown in FIG. 8, the side guard pipe 30 can be provided with a pressurization unit 33. The pressurization unit 33 is for applying pressure on the side guard pipe 30 to enable the side guard pipe 30 to be smoothly deflated during deflation, and to ensure the deflation speed of the side guard pipe 30. As an illustrative example, the pressurization unit 33 can be at least one elastic strip, and be configured as encircling on an outer periphery of the side guard pipe 30. The volume of the deflated side guard pipe 30 is decreased, such that the level of a covering object originally covering the outermost part of the turning air mattress 1 and supported by the side guard pipe 30 is reduced. When the turning air mattress 1 performs the body turning function, the covering object does not become too tense and does not obstruct the body turning operation.

FIG. 9 shows an internal structural schematic diagram of an implementation form of the side guard pipe 30 of the embodiment. The side guard pipe 30 can include a first air cell 34, a second air cell 35 and a third air cell 36. The third air cell 36 is enveloped in the second air cell 35. The first air cell 34 is stacked on the second air cell 35, and is in communication with the third air cell 36 by a pipeline. The second air cell 35 is not in communication with the first air cell 34 and the third air cell 36. When the turning air mattress 1 performs the body turning function, the first air cell 34 and the third air cell 36 can jointly be deflated to lower the height of the side guard pipe 30. Thus, as described above, an insufficient body turning angle, which is caused when a covering object (not shown) originally covering the outermost part of the side guard pipe 30 bears the patient due to the limitation in length or elasticity in a way that the angle and degree of the movement of the body of the patient is limited, can be avoided. When the first air cell 34 and the third air cell 36 are deflated, the amount of air in the second air cell 35 is preserved; that is, the volume of the second air cell 35 is kept unchanged, such that the side guard pipe 30 is maintained at a certain height. For example, the height of the side guard pipe 30 is maintained to be higher than or equal to the height of the upper portion 10A of the left air chamber 11 of the turning air cell 10 or the right air chamber 12 of the turning air cell 10, thus preventing the patient from falling off on the side of the turning air mattress when the body of the patient is turned.

In the embodiment, the side guard pipe 30 can have a plurality of micropores (not shown) having a diameter of 1.04±0.07 mm, such that air in the side guard pipe 30 can be dissipated through the micropores, thus forming a flowing airflow for producing a heat dissipation effect on the patient in a reclined position.

Figure 10:
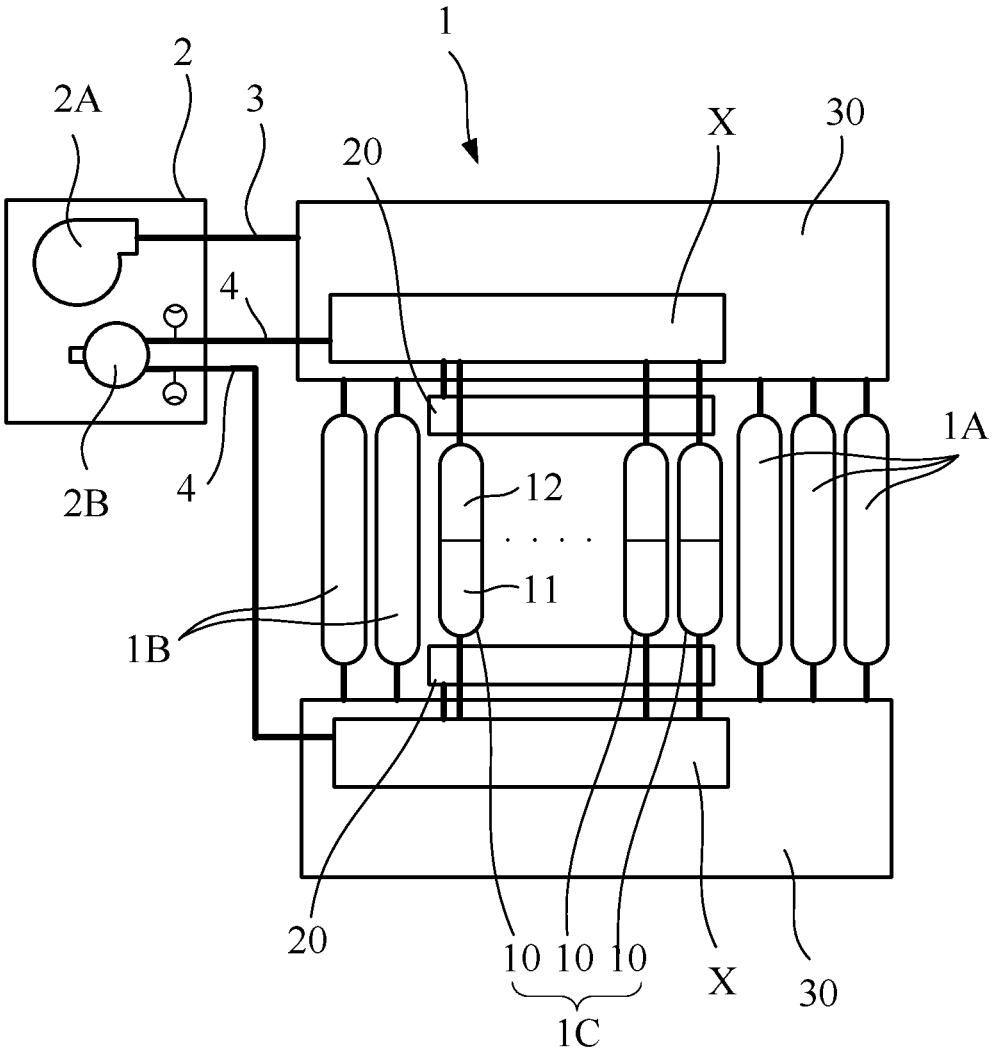
FIG. 10 is a schematic diagram of an air distribution system and an air loop configuration of a turning air mattress according to a fourth embodiment of the present invention.

FIG. 10 shows a schematic diagram of an air distribution system and an air loop configuration of a turning air mattress according to a fourth embodiment of the present invention.

The turning air mattress 1 can include a pillow air cell region 1A, a lower limb air cell region 1B, a turning air cell region 10 configured between the pillow air cell region 1A and the lower limb air cell region 1B, two movement preventing unit 20 configured on two left and right sides of the turning air cell region 1C, and two side guard pipes 30 configured on two left and right outer sides of the turning air mattress 1. The pillow air cell region 1A supports the head of the patient, and the lower limb air cell region 1B supports the lower limbs of the patient. the lower limbs supported are, for example, heels that are supported, or calves and heels that are simultaneously supported.

As shown in FIG. 10, the turning air mattress 1 is connected to an inflation/deflation control host 2. The inflation/deflation control host 2 includes an inflation unit 2A and a deflation unit 2B for controlling inflation and deflation of various elements, components and air cells in the turning air mattress 1. The inflation unit 2A can be a blower, a compressor or any airflow generating device; the deflation unit 2B can be a directional valve, an electromagnetic valve, or any other valve for controlling a fluid; however, the present invention is not limited to the above examples.

In the embodiment, the inflation unit 2A in the inflation/deflation control host 2 is connected by an air inlet tube 3 to one of the two side guard pipes 30, for example, the side guard pipe 30 on the top of FIG. 10. Air cells in the pillow air cell region 1A and air cells in the lower limb air cell region 1B can be connected to the two side guard pipes 30 on upper and lower sides by pipelines. The movement preventing units 20 are connected to inner bags X of the side guard pipes 30 of the corresponding sides. The inner bags X of the two side guard pipes 30 can be connected to the deflation unit 2B in the inflation/deflation control host 2 by an air outlet tube 4. The inner bags X are, for example but not limited to, the first air cell 34 and the third air cell 36 in communication with each other in FIG. 9.

The right air chamber 12 of the turning air cell 10 in the turning air cell region 1C can be connected to the inner bags X of the side guard pipe 30 of the same side by the first ventilation hole 121 (referring to FIG. 2) on the side of the right air chamber 12 and a pipeline. On the other hand, the left air chamber 11 of the turning air cell 10 in the turning air cell region 1C can be connected to the inner bags X of the side guard pipe 30 on the same side by the first ventilation hole 111 (referring to FIG. 2) on the side of the left air chamber 11 and a pipeline.

A plurality of electromagnetic valves can be provided on a pipeline (not shown) to accordingly perform control of inflation or deflation on different air cells and air chambers in the turning air mattress 1 according to a control instruction received.

Figure 11:
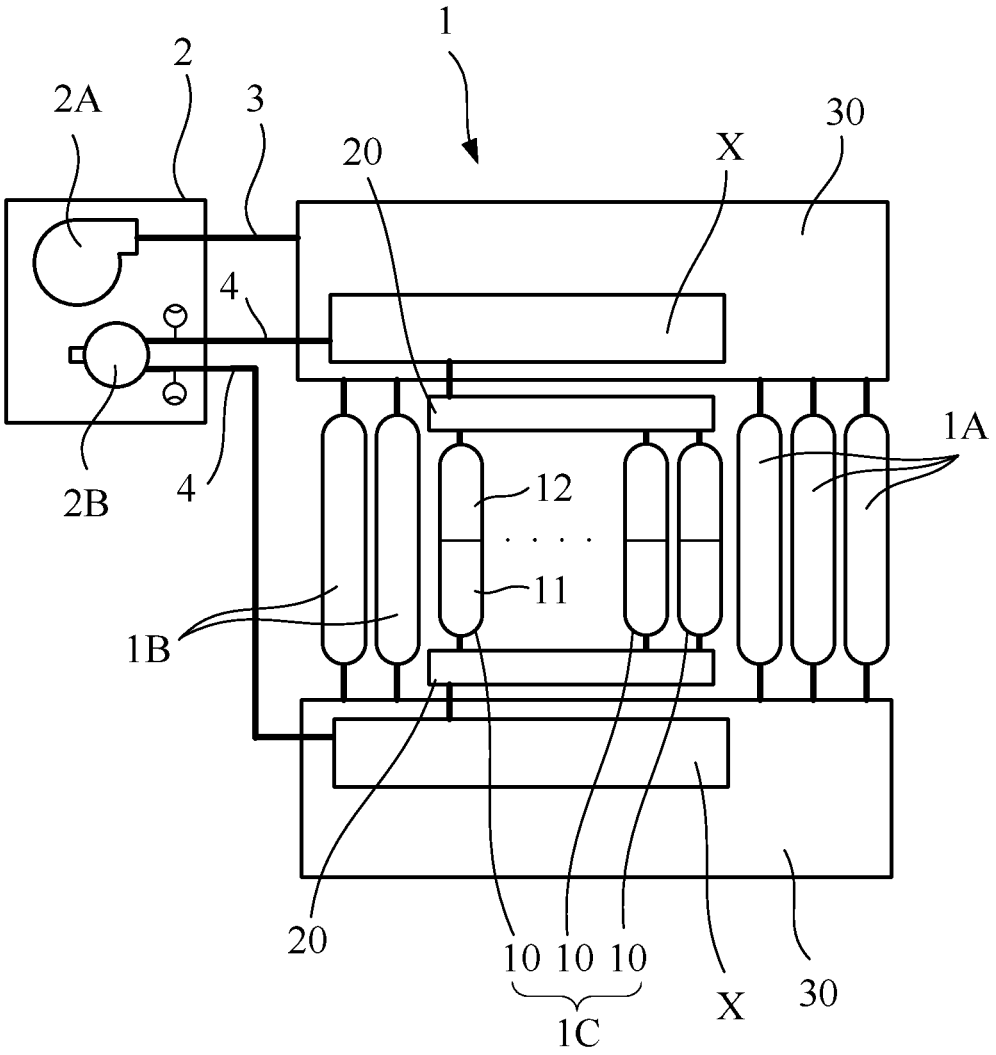
FIG. 11 is a schematic diagram of an air distribution system and an air loop configuration of a turning air mattress according to a fifth embodiment of the present invention.

FIG. 11 shows a schematic diagram of an air distribution system and an air loop configuration of a turning air mattress according to a fifth embodiment of the present invention.

The fifth embodiment mainly differs from the fourth embodiment by the air loop configuration between the turning air cells and the movement preventing units. In the embodiment, the movement preventing units 20 are respectively connected to the inner bags X of the side guard pipes 30 of the corresponding sides. The turning air cells 10 in the turning air cell region 1C are connected to the movement preventing unit 20 on the right through the first ventilation holes on the side of the right air chamber 12 by pipelines, and the turning air cells 10 in the turning air cell region 1C are connected to the movement preventing unit 20 on the left through the first ventilation holes on the side of the left air chamber 11 by pipelines. Accordingly, a deflation path of the turning air cells 10 sequentially passes through the movement preventing units 20 and the inner bags X of the side guard pipes 30 and communicates with the deflation unit 2B through the air outlet tube 4.

Figure 12:
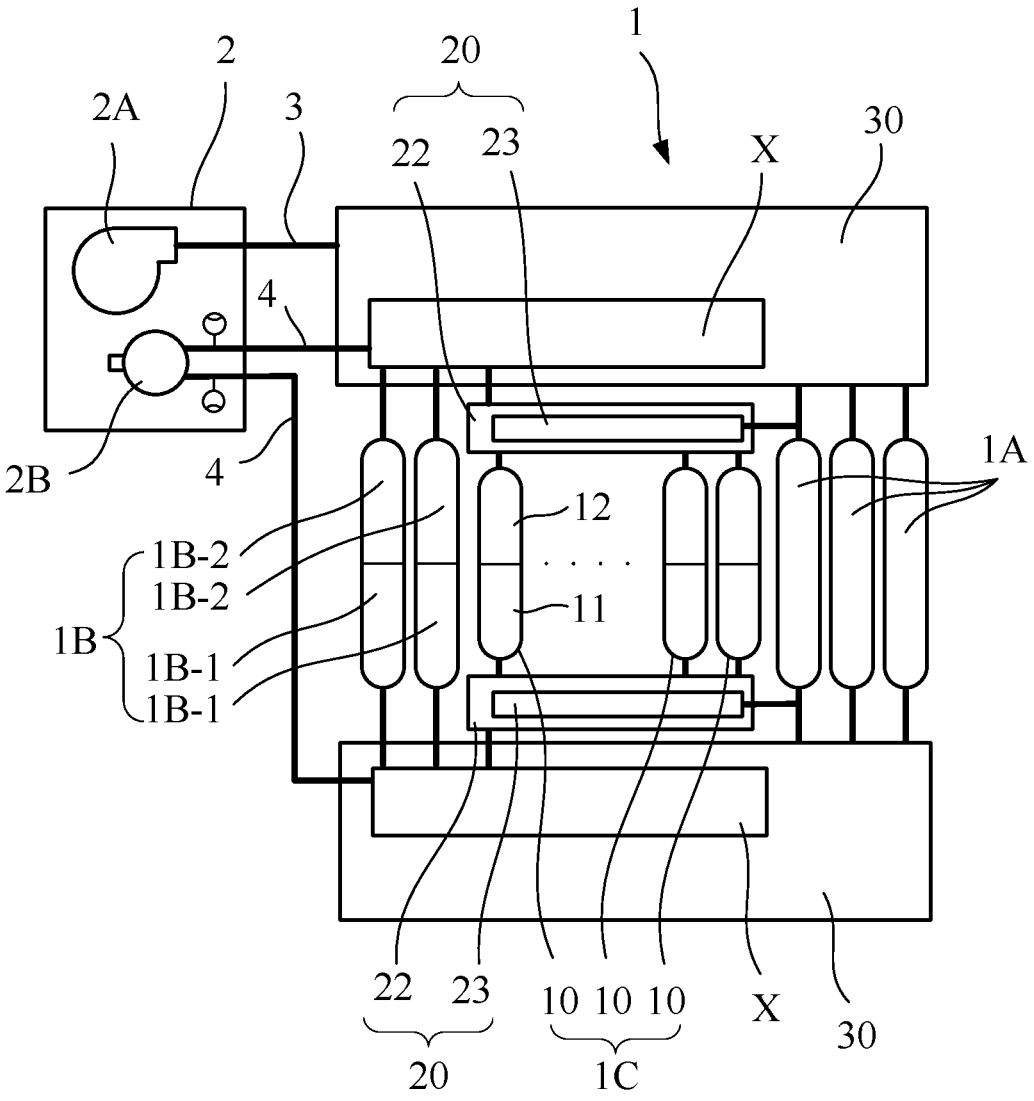
FIG. 12 is a schematic diagram of an air distribution system and an air loop configuration of a turning air mattress according to a sixth embodiment of the present invention.

FIG. 12 shows a schematic diagram of an air distribution system and an air loop configuration of a turning air mattress according to a sixth embodiment of the present invention. The sixth embodiment mainly differs from the fifth embodiment by the movement preventing units and the air loop configuration of heel pipes.

In the embodiment, the movement preventing unit 20 can have a first air chamber 22 and a second air chamber 23.

Also referring to FIG. 7, the second air chamber 23 is enveloped in the first air chamber 22, and the first air chamber 22 is not in communication with the second air chamber 23. The first air chamber 22 is in communication with the turning air cells 10 in the turning air cell region 1C, and the second air chamber 23 is in communication with the air cells in the pillow air cell region 1A. Accordingly, the first air chamber 22 can be controlled to deflate and thus assist in the body turning function, and the second air chamber 23 is still preserved with air to support the body of the patient to further prevent the body of the patient from coming into contact with the bottom surface of the bed frame.

Further, each air cell in the lower limb air cell region 1B can also have a second left air chamber 1B-1 and a second right air chamber 1B-2. The second left air chambers 1B-1 are connected to the inner bags X of the side guard pipe 30 on the left, and the second right air bags 1B-2 are connected to the inner bags X of the side guard pipe 30 on the right. Thus, the above configuration allows the lower limp air cell region 1B to also assist in the body turning function.

On the basis of the turning air mattress of the above embodiment, when the body of a patient in a reclined position needs to be turned, the inflation/deflation control host 2 can be prompted by a body turning instruction generated to perform a corresponding body turning procedure. In an embodiment, an example of a control method for controlling the air mattress includes: (a) prompting the inflation/deflation control host 2 by the body turning control instruction to correspondingly deflate one of the left air chamber 11 and the right air chamber 12 of the turning air cell 10 (for example, when the body turning control instruction indicates turning to the left, the left air chamber 11 of the turning air cell 10 is deflated); and (b) deflating at least one air chamber of the movement preventing unit 20 located on the same side as the deflated air chamber of the turning air cell 10. Accordingly, in response to the body turning control instruction, the left air chamber 11 or the right air chamber 12 of the turning air cell 10 is deflated such that the height thereof is lowered, and the height of the movement preventing unit 20 of the corresponding side is also lowered, thereby tilting the body of the patient reclining on the turning air mattress and achieving an effect of body turning. Step (a) and step (b) described above are merely an example, and the sequences for performing the steps are not defined. After the inflation/deflation control host 2 receives the body turning control instruction, means for deflating the corresponding air chamber in the turning air cell 10 and the movement preventing unit 20 on the same side can be used to perform the body turning procedure. Further, the corresponding air chamber of the turning air cell 10 and the movement preventing unit 20 on the same side can be simultaneously deflated or be deflated in an order.

In the above control method, the deflation rate of any one of the air chambers of the turning air cell 10 is preferably greater than the deflation rate of at least one air chamber of the movement preventing unit 20 on the same side. For example, by configuring the diameters of the first ventilation holes of the left air chamber and the right air chamber of the turning air cell 10 to be greater than the diameter of the second ventilation holes of the movement preventing unit 20, the deflation rate of the air chambers of the turning air cell 10 can be greater than the deflation rate of at least one air chamber of the movement preventing unit 20 on the same side. However, the present invention is not limited to the above example. The control of the deflation rate can also be controlled by controlling an opening degree of an electromagnetic valve on a pipeline according to a body turning control instruction or other control instructions, such that level by which the deflation rate of the air chamber in the turning air cell 10 is greater than the deflation rate of at least one air chamber of the movement preventing unit 20 on the same side can be more accurately controlled.

In the embodiment, the method can further include step (c): deflating at least one air cell of the side guard pipe 30 located on the same side as the air chamber controlled to be deflated of the turning air cell 10. For example, in the side guard pipe 30 in FIG. 9, the first air cell 34 and the third air cell 36 can be correspondingly deflated according to the body turning control instruction or other control instructions.

In the embodiment, the method can further include step (d): deflating at least one air chamber of the lower limb air cell located on the same side as the air chamber controlled to be deflated of the turning air cell 10, such that the lower limb air cell region 1B also assists in the body turning function. It should be understood that, the sequences of the description on steps (a) to (d) are merely an example of illustrations and the sequences for performing the steps are not limited to the above example.

Figure 13:
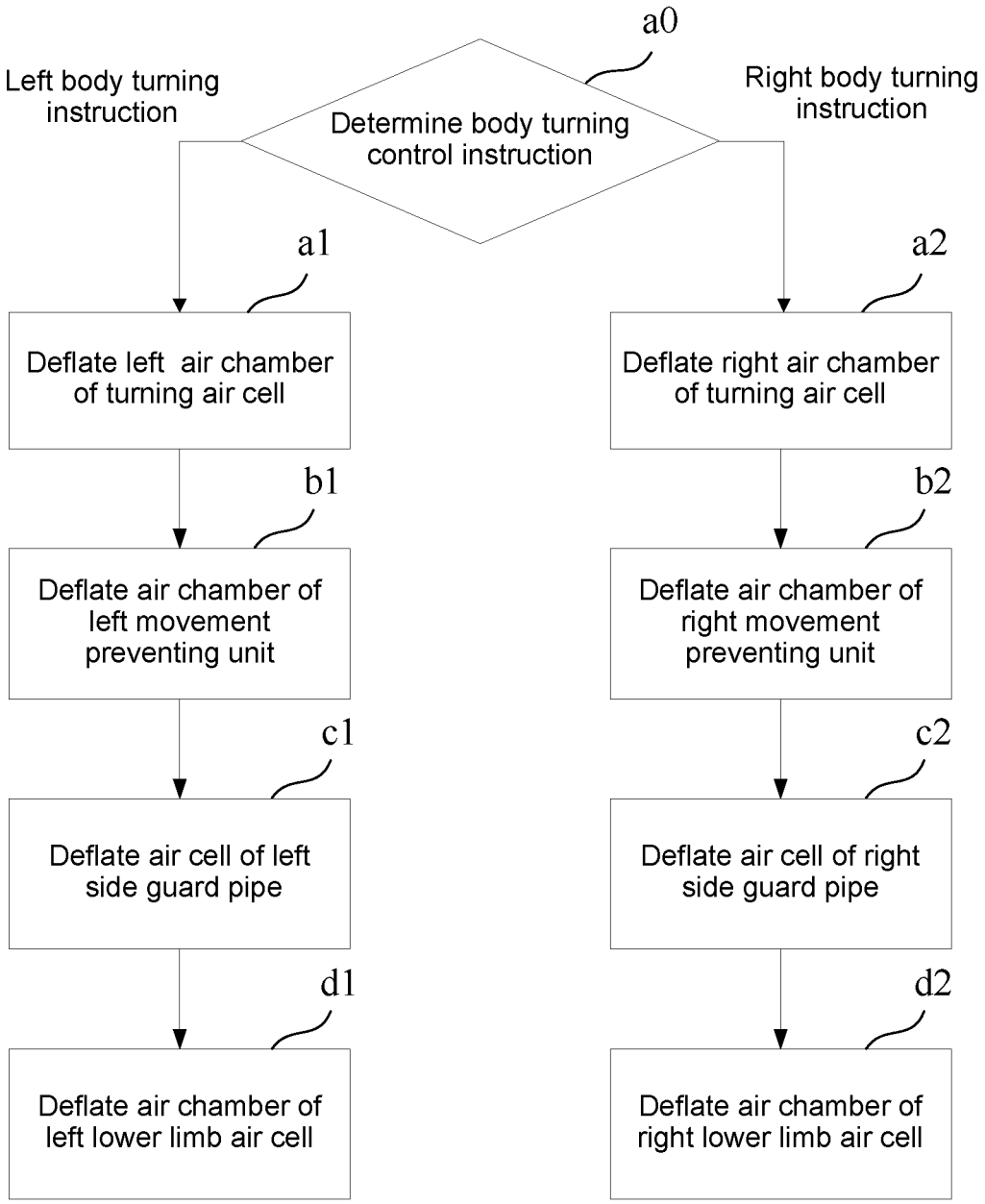
FIG. 13 is a flowchart of a control method for an air mattress according to an embodiment of the present invention.

FIG. 13 shows a flowchart of a control method for an air mattress according to an embodiment of the present invention. For example, when the inflation/deflation control host 2 receives a body turning instruction, the inflation/deflation control host 2 first performs a determination on the body turning instruction (step a0) so as to determine whether the body turning instruction is a left body turning instruction or a right body turning instruction.

When the body turning instruction is a left body turning instruction, the inflation/deflation control host 2 corresponding performs a procedure of: deflating the left air chamber of the turning air cell (step a1), deflating at least one air chamber of the left movement preventing unit (step b1), deflating at least one air cell of the left side guard pipe (step c1), and deflating at least one air chamber of the left lower limb air cell (step d1).

When the body turning instruction is a right body turning instruction, the inflation/deflation control host 2 correspondingly performs a procedure of: deflating the right air chamber of the turning air cell (step a2), deflating at least one air chamber of the right movement preventing unit (step b2), deflating at least one air cell of the right side guard pipe (step c2), and deflating at least one air chamber of the right lower limb air cell (step d2).

Figure 14:
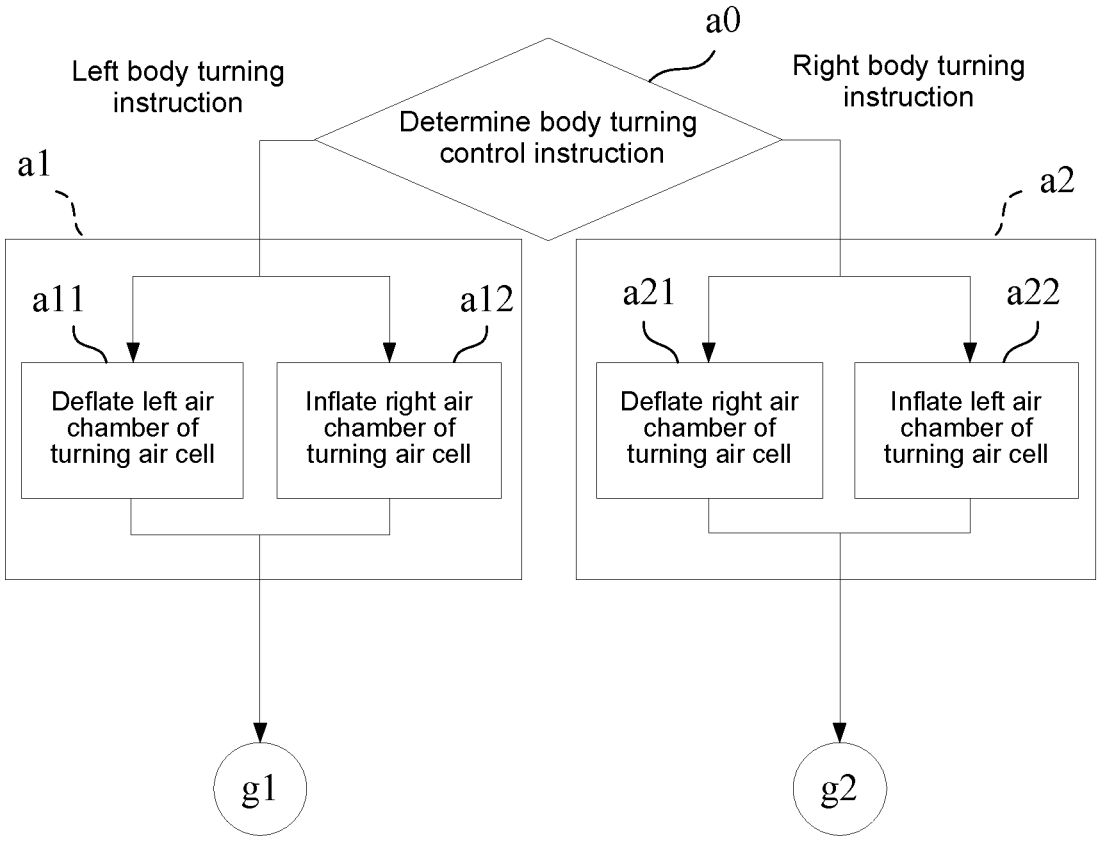
FIG. 14 is a flowchart of a control method for an air mattress according to another embodiment of the present invention.
Figure 15:
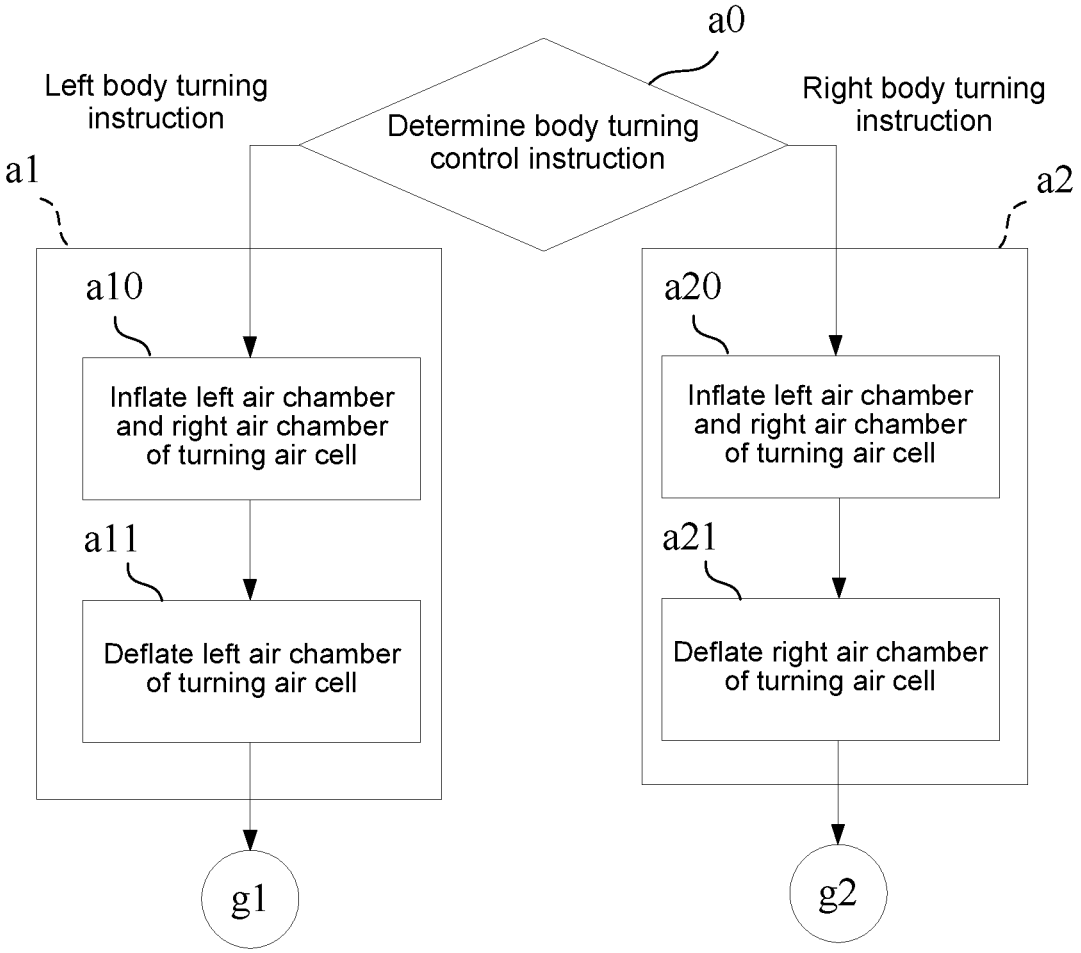
FIG. 15 is a flowchart of a control method for an air mattress according to another embodiment of the present invention.

The step of deflating the turning air cell, such as step (a1) and step (a2) above, can include further control means for further assisting a control range of a body turning angle of the patient. Referring to FIG. 14 and FIG. 15, FIG. 14 shows a flowchart of a control method for an air cell according to another embodiment of the present invention, and FIG. 15 shows a flowchart of a control method for an air cell according to yet another embodiment of the present invention.

As in the embodiment shown in FIG. 14, when the inflation/deflation control host 2 receives a left body turning instruction, the inflation/deflation control host 2 correspondingly performs the following steps: (a11) deflating the left air chamber of the turning air cell, and (a12) inflating the right air chamber of the turning air cell by, for example, 3 to 5 mmHg, to further expand the right air chamber of the turning air cell and to further elevate the right side of the body of the patient, increasing the body turning angle. The amount of inflation of the right air chamber can be controlled at a certain level, such that the air cell is expanded within an appropriate range without damaging the main structure of the air cell. In the embodiment, step (a11) and step (a12) can be, for example but not limited to, performed simultaneously. Next, the inflation/deflation control host 2 can be arranged to perform a subsequent procedure (g1), such as ending an operation, deflating the left air chamber of the turning air cell so as to prevent the left of the body of the patient from persistently reclining on an air chamber having an overly high pressure, and inflating the left air chamber of the turning air cell after waiting for a predetermined period of time; and then performing step (a1) to achieve automatic body turning, the steps (b1) to (d1) above, or other steps.

On the other hand, when the inflation/deflation control host 2 receives a right body turning instruction, the inflation/deflation control host 2 correspondingly performs the following steps: (a21) deflating the right air chamber of the turning air cell, and (a22) inflating the left air chamber of the turning air cell. Next, the inflation/deflation control host 2 can be arranged to perform a subsequent process (g2), wherein contents of the subsequent procedure (g2) can be referred from the description on the subsequent procedure (g1). Details of step (a21) and step (a22) are similar to those of step (a11) and step (a12) above, and are omitted herein. The embodiment differs from steps (a1) and (a2) of the embodiment in FIG. 13 in that, when an air chamber of the turning air cell is deflated to perform the body turning procedure, another air chamber of the turning air cell is additionally inflated to further elevate one side of the body of the patient.

As in the embodiment shown in FIG. 15, when the inflation/deflation control host 2 receives a left body turning instruction, the inflation/deflation control host 2 correspondingly performs the following steps: (a10) inflating both the left and right air chambers of the turning air cell by, for example, 3 to 5 mmHg; and (a11) deflating the left air chamber of the turning air cell. Next, the inflation/deflation control host 2 can be arranged to perform the subsequent procedure (g1), which can be referred from the above description associated with the subsequent procedure (g1). In step (a10), the two left and right air chambers of the turning air cell can be further expanded to further elevate the body of the patient, and the air chamber on one of the sides can be maintained in a more expanded state by deflating the air chamber on the other side, so as to further increase the body turning angle. In addition, the amount of inflation of the two left and right air chambers can be controlled with a certain level, such that the air cell is expanded within an appropriate range without damaging the main structure of the air cell. On the other hand, when the inflation/deflation control host 2 receives a right body turning instruction, the inflation/deflation control host 2 correspondingly performs the following steps: (a20) inflating both of the left and right air chambers of the turning air cell; and (b21) deflating the right air chamber of the turning air cell. Next, the inflation/deflation control host 2 can be arranged to perform the subsequent procedure (g2), which can be referred from the above description associated with the subsequent procedure (g2). The embodiment differs from steps (a11) to (a22) of the embodiment in FIG. 14 in that, both of the left and right air chambers of the turning air cell are inflated to together elevate the body of the patient, in a way that the body of the patient is kept less likely to sliding and the body turning process is kept more stable when deflation is performed on one side.

In conclusion, a turning air mattress, a turning air cell and a control method are provided by the embodiments above. With configurations and designs in the structures or control method, a patient is assisted to reach a sufficient body turning angle, and the risk of pressure sores caused by the structure of an air mattress pressing against the body of a patient is effectively reduced.

The present disclosure is illustrated by various aspects and embodiments. However, persons skilled in the art understand that the various aspects and embodiments are illustrative rather than restrictive of the scope of the present disclosure. After perusing this specification, persons skilled in the art may come up with other aspects and embodiments without departing from the scope of the present disclosure. All equivalent variations and replacements of the aspects and the embodiments must fall within the scope of the present disclosure. Therefore, the scope of the protection of rights of the present disclosure shall be defined by the appended claims.

What is claimed is:

1. A turning air mattress, comprising at least one turning air cell, the turning air cell comprising:

a left air chamber and a right air chamber;

wherein a top side of the left air chamber and a top side of the right air chamber collectively define an upper portion; and a bottom side of the left air chamber and a bottom side of the right air chamber collectively define a lower portion, the lower portion is located on a side opposite to the upper portion, a width of the lower portion being smaller than a width of the upper portion;

wherein, the left air chamber and the right air chamber of the turning air cell is configured to be correspondingly inflated and deflated to achieve an effect of body turning;

wherein, when the left or right air chamber is deflated, bent points are formed on the upper portion of the corresponding side and corresponding to two ends of the lower portion, thereby enhancing the effect of body turning.

2. The turning air mattress according to claim 1, wherein a ratio of the width of the lower portion to the width of the upper portion is between 33% and 75%.

3. The turning air mattress according to claim 1, further comprising:

a movement preventing unit, provided on any one of left and right sides of the turning air cell, the movement preventing unit comprising a leaning portion that can be leaned against by the turning air cell.

4. The turning air mattress according to claim 3, wherein each of the left air chamber and the right air chamber has a first ventilation hole, and the movement preventing unit has a second ventilation hole, and a diameter of the second ventilation hole is smaller than a diameter of the first ventilation hole.

5. The turning air mattress according to claim 3, wherein the movement preventing unit has a first air chamber and a second air chamber, the second air chamber is enveloped in the first air chamber, and the first air chamber is in communication with the turning air cell and is not in communication with the second air chamber.

6. The turning air mattress according to claim 1, further comprising:

a movement preventing unit and a side guard pipe, the side guard pipe and the movement preventing unit integrally formed and adjacent to any one of left and right sides of the turning air cell.

7. A control method for the turning air mattress of claim 1, the turning air mattress comprising the turning air cell and a movement preventing unit, the movement preventing unit provided on any one of left and right sides of the turning air cell, the method comprising:

(a) deflating any air chamber of the turning air cell; and (b) deflating at least one air chamber of the movement preventing unit located on a same side as the deflated air chamber of the turning air cell.

8. The control method according to claim 7, wherein a deflation rate of any air chamber of the turning air cell is greater than a deflation rate of the at least one air chamber of the movement preventing unit on the same side.

9. The control method according to claim 7, wherein the turning air mattress further comprises a side guard pipe, and the side guard pipe is provided on any one of left and right sides of the turning air cell; the method further comprising:

(c) deflating at least one air cell of the side guard pipe located on a same side as the deflated air chamber of the turning air cell.

10. A turning air cell for use with an air mattress, comprising:

a left air chamber and a right air chamber;

wherein, a top side of the left air chamber and a top side of the right air chamber collectively define an upper portion; and a bottom side of the left air chamber and a bottom side of the right air chamber collectively define a lower portion, the lower portion is substantially parallel to the upper portion;

wherein, the turning air cell further comprises a first side portion and a second side portion connected between the upper portion and the lower portion, between the upper portion and the lower portion is a first height, between the upper portion and the first side portion or the second side portion is a second height, and the second height is substantially smaller than the first height;

wherein, the left air chamber and the right air chamber of the turning air cell is configured to be correspondingly inflated and deflated to achieve an effect of body turning;

wherein, when the left or right air chamber is deflated, bent points are formed on the upper portion of the corresponding side and corresponding to two ends of the lower portion, thereby enhancing the effect of body turning.

* * * * *